US006800020B1

(12) United States Patent
Boyd et al.

(10) Patent No.: US 6,800,020 B1
(45) Date of Patent: Oct. 5, 2004

(54) WEB-STYLE PAD CONDITIONING SYSTEM AND METHODS FOR IMPLEMENTING THE SAME

(75) Inventors: John M. Boyd, Atascadero, CA (US); Katrina A. Mikhaylich, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/678,423

(22) Filed: Oct. 2, 2000

(51) Int. Cl.[7] ..... B24B 1/00; B24B 21/00

(52) U.S. Cl. ..... 451/56; 451/168; 451/288; 451/305; 451/443; 451/72

(58) Field of Search ..... 451/305, 306, 451/307, 443, 444, 491, 493, 56, 36, 37, 41, 57, 59, 65, 72, 168, 258, 287, 288, 290, 300, 285

(56) References Cited

U.S. PATENT DOCUMENTS

| | | | | |
|---|---|---|---|---|
| 4,062,463 A | | 12/1977 | Hillman et al. | 214/301 |
| 4,202,071 A | | 5/1980 | Scharpf | 15/302 |
| 4,347,689 A | * | 9/1982 | Hammond | 451/307 |
| 4,356,671 A | * | 11/1982 | Gabrielson et al. | 134/9 |
| 4,382,308 A | | 5/1983 | Curcio | 15/77 |
| 5,167,667 A | | 12/1992 | Prigge et al. | 8/137 |
| 5,317,778 A | | 6/1994 | Kudo et al. | 15/88.3 |
| 5,357,645 A | | 10/1994 | Onodera | 15/97.1 |
| 5,361,449 A | | 11/1994 | Akimoto | 15/302 |
| 5,486,134 A | | 1/1996 | Jones et al. | 451/209 |
| 5,490,809 A | | 2/1996 | Jones et al. | 451/60 |
| 5,581,837 A | | 12/1996 | Uchiyama et al. | 15/77 |
| 5,624,501 A | | 4/1997 | Gill, Jr. | 134/6 |
| 5,639,311 A | | 6/1997 | Holley et al. | 134/6 |
| 5,645,471 A | * | 7/1997 | Strecker | 451/299 |
| 5,651,160 A | | 7/1997 | Yonemizu et al. | 15/302 |
| 5,675,856 A | | 10/1997 | Itzkowitz | 15/77 |
| 5,693,148 A | | 12/1997 | Simmons et al. | 134/18 |
| 5,725,417 A | | 3/1998 | Robinson | |
| 5,778,554 A | | 7/1998 | Jones | 34/58 |
| 5,806,126 A | | 9/1998 | de Larios et al. | 15/102 |
| 5,857,898 A | | 1/1999 | Hiyama et al. | 451/56 |
| 5,875,507 A | | 3/1999 | Stephens et al. | 15/102 |
| 5,879,226 A | | 3/1999 | Robinson | 451/287 |
| 5,919,082 A | | 7/1999 | Walker et al. | 451/41 |
| 5,944,585 A | * | 8/1999 | Nagahara et al. | 451/304 |
| 6,062,955 A | | 5/2000 | Liu | |
| 6,069,080 A | | 5/2000 | James et al. | 438/691 |
| 6,312,319 B1 | * | 11/2001 | Donohue et al. | 451/168 |
| 6,322,427 B1 | * | 11/2001 | Li et al. | 451/443 |
| 6,361,411 B1 | * | 3/2002 | Chopra et al. | 451/285 |

FOREIGN PATENT DOCUMENTS

| | | | |
|---|---|---|---|
| EP | 0 812 656 A2 | 12/1997 | B24B/37/04 |
| JP | 03060183 | 3/1991 | H05K/3/00 |
| WO | WO 98/45090 | 10/1998 | B24B/53/10 |
| WO | WO 99/18605 | 4/1999 | H01L/21/3105 |
| WO | WO 99/22908 | 5/1999 | B24B/37/04 |

* cited by examiner

*Primary Examiner*—Hadi Shakeri
(74) *Attorney, Agent, or Firm*—Martine & Penilla, LLP

(57) ABSTRACT

A system for conditioning a pad is provided. The system includes a pad conditioning media, a feed-roll containing a supply of the pad conditioning media, and a take-up roll for receiving an end of the pad conditioning media. Further included in the system is a pressure application member defined between the feed-roll and the take-up roll. The pressure application member is designed to apply pressure onto the pad conditioning media as the pad conditioning media is applied against the pad to cause a conditioning of a surface of the pad.

6 Claims, 12 Drawing Sheets

WEB-STYLE PAD CONDITIONING SYSTEM AND METHODS FOR IMPLEMENTING THE SAME

BACKGROUND OF THE INVENTION

1. Field of the Invention

The present invention relates generally to chemical mechanical polishing (CMP) Em systems and techniques for improving the performance and effectiveness of CMP operations. Specifically, the present invention relates to the CUM systems that utilize a web-style conditioner for conditioning pad surfaces.

2. Description of the Related Art

In the fabrication of semiconductor devices, there is a need to perform CMP operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. At each metallization level and/or associated dielectric layer, there is a need to planarize the metal and/or dielectric material. Without planarization, fabrication of additional metallization layers becomes substantially more difficult due to the higher variations in the surface topography. In other applications, metallization line patterns are formed in the dielectric material, and then metal CMP operations are performed to remove excess metallization.

CMP systems typically implement belt, orbital, or brush stations in which belts, pads, or brushes are used to polish, buff, and scrub one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 100. The CMP system 100 of FIG. 1 is a belt-type system, so designated because the preparation surface is an endless polishing pad 108 mounted on two drums 114 which drive the polishing pad 108 in a rotational motion as indicated by polishing pad rotation directional arrows 116. A wafer 102 is mounted on a carrier 104. The carrier 104 is rotated in direction 106. The rotating wafer 102 is then applied against the rotating polishing pad 108. Some CMP processes require significant force F to be applied. A platen 112 is provided to stabilize the polishing pad 108 and to provide a solid surface onto which to apply the wafer 102. Slurry 118 including of typically an aqueous solution containing dispersed abrasive particles (e.g., $SiO_2$, $Al_2O_3$, $CeO_2$, etc.) is introduced upstream of the wafer 102. The process of scrubbing, buffing and polishing of the surface of the wafer could be achieved by using either a non-fixed abrasive polishing pad or a fixed abrasive polishing pad. Due to having different characteristics, the conditioning of the non-fixed abrasive polishing pads are to some extent different than that of the fixed abrasive polishing pads. Below are brief descriptions of the conditioning of non-fixed abrasive polishing pads as well as fixed abrasive polishing pads.

The non-fixed abrasive polishing pads are composed of porous or fibrous materials and fixed abrasive particles, which are introduced into the system in the form of an aqueous solution (also known as slurry). As illustrated in FIG. 1, after the non-fixed abrasive polishing pad 108 polishes the wafer 102, the conditioner disk 122 of the conditioning assembly 110 is applied to the surface of the non-fixed abrasive polishing pad 108 thus removing the residue, consisting of abrasive particles of the slurry and the particulates removed from the wafer 102 (which clog the porous 61 surface of the pad 108). As illustrated in the cross-sectional view of a conditioning assembly 110 of FIG. 1A-1, the surface of a conditioner disk 122 includes a diamond array 124. The non-fixed abrasive polishing pad 108 is conditioned as the conditioner disk 122 and thus the diamond array 124 are moved along a track bar 123 and across the polishing surface of the non-fixed abrasive polishing pad 108. Accordingly, in non-fixed abrasive polishing pad CMP systems, the conditioner disk 122 removes the particulate materials and the attached slurry materials from the surface of the non-fixed abrasive polishing pad 108 thereby cleaning and roughening the non-fixed abrasive polishing pad 108 as well as exposing a fresh layer of the non-fixed abrasive polishing pad.

Ordinarily, different sizes of conditioning disks can be used to condition the surface of the non-fixed abrasive polishing pad 108. Furthermore, as some non-fixed abrasive polishing pads require conditioning by extra fine abrasive particles, the conditioning disks may have abrasive particles having various sizes. One example of abrasive particles is defined as diamond arrays, which may be mounted on the carrier disks utilizing different bonding technologies. However, one common problem in utilizing diamond arrays for conditioning the non-fixed abrasive polishing pads is the dislodgment of diamonds of a diamond arrays. As illustrated in FIG. 1A-2, the dislodgment of diamonds 124' of a diamond array 124 occurs as a result of the extensive wear of the conditioning disk 122. Furthermore, the dislodgment of the diamonds 124' occur irrespective of the size of the carrier disks 122 and the dimensions of the diamonds 124' of the diamond arrays 124 and the technology implemented to mount the diamond arrays 124 on the conditioner disks 122. The dislodged diamonds 124' could remain on the polishing pad 108, could be caught between polishing pad 108 and the wafer 102 during the polishing cycle, and could scratch the surface of the wafer 102 being polished.

Another challenge in utilizing conditioning disks with diamond arrays is maintaining well-kept diamond arrays having very small diamonds. Even after a short wear time of the conditioning disk, these diamonds easily become loose. Even small diamonds being loose on a pad during polishing could cause severe scratching of the surface of the semiconductor wafer. This could create electrical shorts in the electronic circuit devices, and could make some devices on the wafer inoperable. This severely reduces yield. Therefore, conditioning disks should be often replaced to avoid excessive wear. In either situation, the dislodgment of the diamonds 124' as well as the extensive wear of the conditioning disk reduce the removal rate of the particulates and the attached slurry. They also increase the overall defects and micro-scratching of wafers during the CMP process. Furthermore, the replacement of the entire conditioner disk is very inconvenient as well as time consuming. Additionally, the CMP system must be taken off-line so as to allow the replacement of the entire conditioner disk or the dislodged diamonds, thereby reducing the throughput of the CMP system.

One particular type of polishing pad, which requires conditioning by extra fine abrasive materials, is a fixed abrasive polishing pad. FIG. 1B-1 depicts a fixed-abrasive polishing pad 108 having a fixed abrasive polishing layer.

Embedded and extended through out the surface of this type of polishing pad are several three-dimensional cylindrical protrusions, defined as "pillars" 108'. Each pillar 108' may have a diameter of approximately about 200 micrometers and an approximate height of about 40 micrometers. The cross-sectional view of the fixed abrasive polishing pad of FIG. 1B-2 reveals that each pillar 108' contains a plurality of abrasive particles 108*a*. Further depicted on the fixed abrasive polishing pad 108 are a plurality of pillar isolation regions 108*b*.Accordingly, in CMP systems wherein fixed abrasive polishing pad 108 are used, the polishing of the wafer 102 is achieved by the friction between the embedded abrasive particles 108*a* and the surface of the wafer 102 in the polishing interface.

Furthermore, in some fixed abrasive CMP systems, additional slurry may be introduced into the polishing interface to enhance and expedite the planarization process. As depicted in FIG. 1B-3, each fixed abrasive pillar 108' consists of a polymer matrix of a desired hardness, and the abrasive particles 108*a* are embedded (i.e., fixed) within each of the pillars 108'. For the pillar 108' to perform the polishing work on the semiconductor substrate (i.e., wafer 102), a top layer 111 of the polymer matrix must be removed in order to expose fresh embedded fixed abrasive particles 108*a* which can then be placed in contact with the surface of wafer 102. Consequently, the fixed abrasive polishing pad 108 must be conditioned so that the polymer layer 111 is removed from the top of the pillars 108' so as to expose fresh fixed abrasive particles 108*a*. Accordingly, the conditioning of fixed abrasive polishing pads is directed toward "dressing" the fixed abrasive polishing pads by exposing fresh abrasive particles. The conditioning of the fixed abrasive polishing pad, which is achieved by the removal of the top layer 111 of the polymer matrix of the fixed abrasive polishing pad pillars so as to expose fresh fixed abrasive particles, is hereinafter referred to as "dressing."

Currently, the dressing of the fixed abrasive polishing pad 108 is commonly achieved by the motion of the topography features of the wafer 102. As illustrated in FIG. 1B-4, the carrier 104 applies the wafer 102 to the fixed abrasive polishing pad 108. Also depicted in FIG. 1B-4 are the edges of a plurality of topography features 102*a*. As a consequence of the friction of the fixed abrasive polishing pad 108 and the wafer features 102*a*,the edges of the topography features 102*a* come into contact with the top layer 111 of polymer matrix thus removing the top layer 111 of the polymer matrix of the pillars 108' , thereby exposing fresh abrasive particles 108*a*. As a result, the dressing of the fixed abrasive polishing pad and thus the chemical mechanical polishing process become wafer topography pattern sensitive. More specifically, the dressing of the fixed abrasive polishing pad 108 becomes dependent upon the relative sizes of the features 102*a* and the pillars 108*a* as well as the number of the edges of the features 102*a* that go across each pillar 108*a* within a specific length of time. Thus, in situations where the sizes of the wafer features 102*a* are small, the fixed abrasive polishing pad 108 is conditioned significantly fast. However, in the situations where the width of the wafer feature 102*a* are larger than approximately 10 microns, the fixed abrasive polishing pad is conditioned at a significantly lower rate. Consequently, the dependency of the removal rate of top layer of polymer matrix of the pillars from the fixed abrasive polishing pads on the feature size and/or density of the wafers can play a significant role in discouraging the use of the fixed abrasive polishing pads to perform chemical mechanical polishing.

A solution would be to decouple the dressing of the fixed abrasive polishing pad from the polishing stage of the chemical mechanical polishing process. In such a situation, the dressing of the fixed abrasive polishing pad may be achieved through the use of an external dressing medium having extra fine abrasive particles resembling the features often found on the surface of wafer to be polished. The fixed abrasive polishing pads have Mylar backings and abrasive particles that are substantially smaller than 1 micron and are preferably around 0.1 micron in diameter. The diamond disks having diamonds that are small enough to perform gentle conditioning work on the aforementioned fixed abrasive pads can be manufactured. However, manufacturing of such diamond dresser disks is not production worthy as the dresser diamond disks wear relatively quickly and thus lose their effectiveness. Therefore, the dresser diamond disks must be replaced after the fixed abrasive polishing pad polishes only a couple of wafers. Furthermore, the dressing diamond disks must be replaced in their entirety with fresh disks thus making it necessary for the CMP system to be taken off-line, thereby reducing throughput. Additionally, the process of replacing them could be very time consuming and labor intensive.

In view of the foregoing, a need therefore exists in the art for a conditioner assembly for use in a chemical mechanical polishing system that will enable conditioning a polishing pad utilized in polishing surface layers of a wafer, wherein the conditioner assembly is less expensive to maintain and is more effectively serviced after the use of the conditioning material degrades the effectiveness of the conditioning operation.

SUMMARY OF THE INVENTION

Broadly speaking, the present invention fills these needs by providing an apparatus and related methods for efficiently conditioning a polishing surface of a polishing pad. Preferably, the CMP system is designed to implement a dressing media that is less expensive to maintain and is more efficiently serviced after it loses its effectiveness to condition. In preferred embodiments, the dressing media is connected between a feed-roll and a take-up roll. It should be appreciated that the present invention can be implemented in numerous ways, including as a process, an apparatus, a system, a device, or a method. Several inventive embodiments of the present invention are described below.

In one embodiment, a polishing pad conditioner for use in a chemical mechanical polishing (CMP) apparatus is disclosed. Included in the polishing pad conditioner is a web dressing media having a contact surface defined between a first point and a second point. The first point is separate from the second point. The web dressing media is configured to be positioned over a fixed abrasive polishing pad such that the contact surface of the web dressing media is configured to be applied to the abrasive polishing surface of the fixed abrasive polishing pad. The polishing pad conditioner further includes a pressure application plate configured to be applied against an application surface of the web dressing media. In another embodiment, a method for conditioning a polishing pad is disclosed. The method includes providing a fixed abrasive polishing pad having an abrasive polishing surface. The fixed abrasive polishing pad is configured to move between a first point and a second point that is separate from the first point. Further included in the method is providing a web dressing media between the first point and the second point. A contact surface of the web dressing media is defined above an abrasive polishing surface of the fixed abrasive polishing pad. Also included in the method is dressing the abrasive polishing surface of the fixed abrasive polishing pad by applying the contact surface of the web dressing media to the abrasive polishing surface of the fixed abrasive polishing pad.

In still a further embodiment, a system for conditioning a pad is disclosed. The system includes a pad conditioning media, a feed-roll containing a supply of the pad conditioning media, and a take-up roll for receiving an end of the pad conditioning media. Also included in the system is a pressure application member defined between the feed-roll and the take-up roll. The pressure application member is designed to apply pressure onto the pad conditioning media as the pad conditioning media is applied against the pad to cause a conditioning of a surface of the pad.

The advantages of the present invention are numerous. Most notably, instead of disk-style or linear pad conditioners, a supply of conditioning media is provided between a feed-roll and a take-up roll in a web handling arrangement. Thus, replacing used portions of the conditioning media with fresh portions of the conditioning media can be accomplished utilizing minimal effort and in significantly less amount of time. Furthermore, the re-supplying of the conditioning media can be achieved easily and expeditiously thereby minimizing the length of time needed to take the chemical mechanical polishing system off-line thus having minimal effect on the system's throughput. Moreover, the programmable indexing feature of the apparatus and the methods of the present invention provides a consistent pad conditioning over time, further eliminates the instability of the conditioning material wear associated with the prior art, improves overall defects, and increases the overall pad life. In addition, the present invention improves the overall micro scratching and defects of the CMP process. Particularly, the apparatus and the methods of the present invention provide for a substantially uniform dressing rate in embodiments wherein substantially fine abrasive conditioning of the polishing surface layers of a polishing pad is desired irrespective of the wafer topography feature density or the wafer topography feature sizes. Most importantly, the embodiments of present invention are very beneficial in the implementation of fixed abrasive technology.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIG. 1A-1 is a cross-sectional view of a diamond array of a conditioning assembly associated with the prior art.

FIG. 1A-2 is a cross-sectional view of a conditioning assembly having al dislodged diamonds associated with the prior art.

FIG. 1B-1 is a plan view of an abrasive polishing pad media associated with the prior art.

FIG. 1B-2 is a cross-sectional view of an abrasive polishing pad media, revealing a plurality of pillars containing a plurality of abrasive particles associated with the prior art.

FIG. 1B-3 is a cross-sectional view of an abrasive polishing pad strip revealing polymer matrix and embedded abrasive particles for a plurality of pillars associated with the prior art.

FIG. 1B-4 is a cross-sectional view of the conditioning of fixed abrasive polishing pads by the motion of the topography features of a wafer associated with the prior art.

FIG. 2A-1 illustrates a belt-type CMP system utilizing a bar-type dressing assembly, in accordance with one embodiment of the present invention.

FIG. 2A-2 is a simplified cross-sectional view of the dressing assembly depicting the relative positions of a feed-roll, a take-up roll, and a dressing media, in accordance with another aspect of the present invention.

FIG. 2A-3 is a simplified cross-sectional illustration of a dressing assembly depicting a feed-roll and a take-up roll, wherein the feed-roll has a supply of dressing media, in accordance with yet another embodiment of the present invention.

FIG. 2B-1 is an illustration of a belt-type CMP system utilizing a bar-type dressing assembly, in accordance with yet another embodiment of the present invention.

FIG. 2B-2 is a cross-sectional view of a dressing assembly, in accordance with another embodiment of the present invention.

DETAILED DESCRIPTION OF EXEMPLARY EMBODIMENTS

Embodiments of pad conditioning systems for use in chemical mechanical polishing, which enable efficient conditioning of layer surfaces of polishing pads are described. The conditioner preferably implements a conditioning media that is less expensive to maintain and is more efficiently serviced after the conditioning media loses its effectiveness to condition. The conditioning material is preferably provided as a conditioning media that is connected between a feed-roll and a take-up roll. This configuration is referred to herein as a web handling system. In preferred embodiments, a dressing assembly is applied to a fixed abrasive polishing pad so as to remove polymer matrix from pillars of the fixed abrasive polishing pad so as to expose fresh fixed abrasive particles.

In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1:
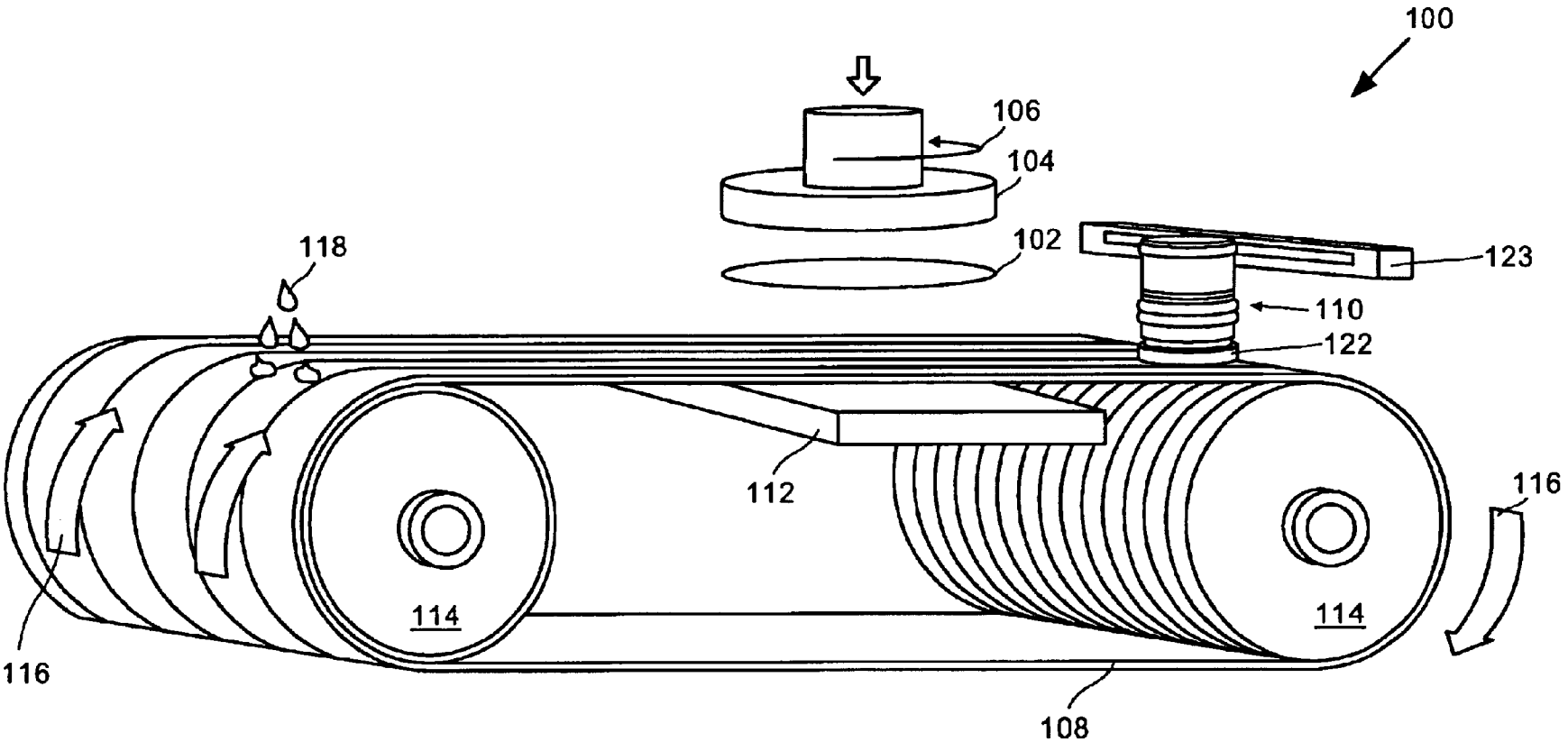
FIG. 1 (prior art)
FIG. 1 illustrates an exemplary prior art CMP system.
Figures 1, 1A:
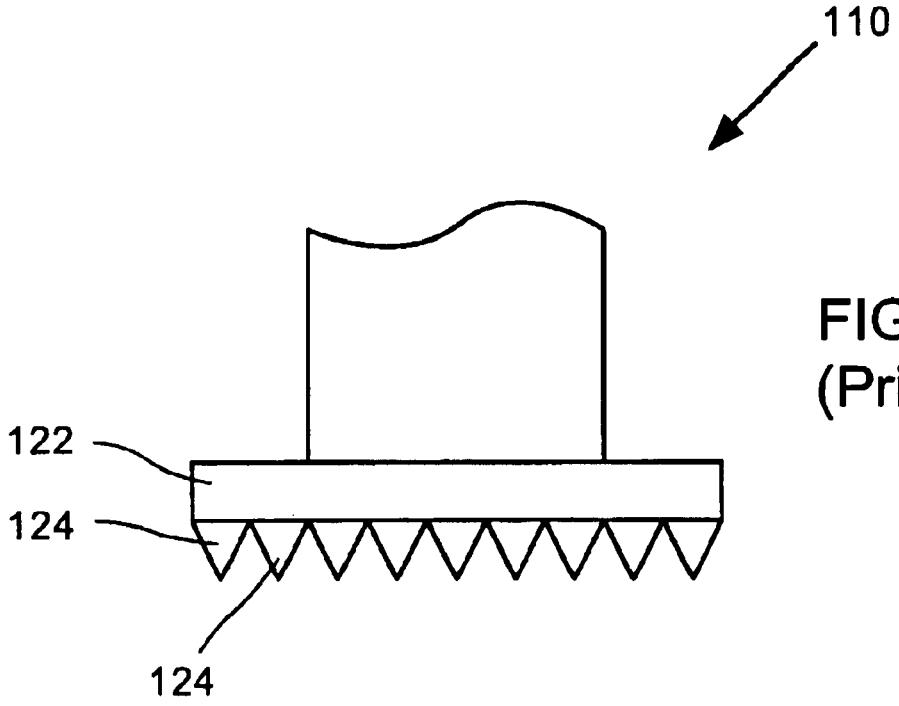
FIG. 1A-1 (Prior Art)
Figures 1, 2A:
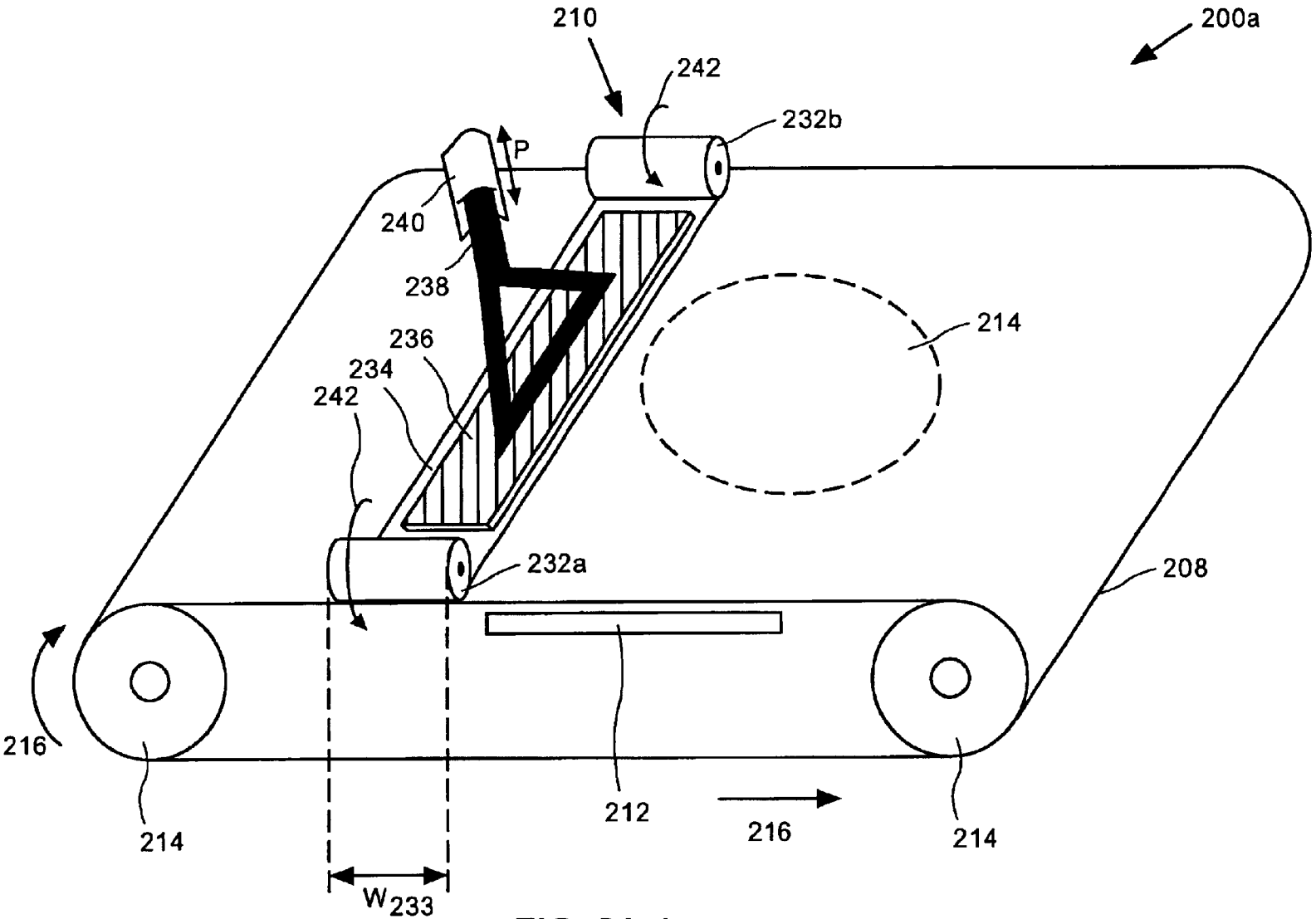
Figures 2, 2A:
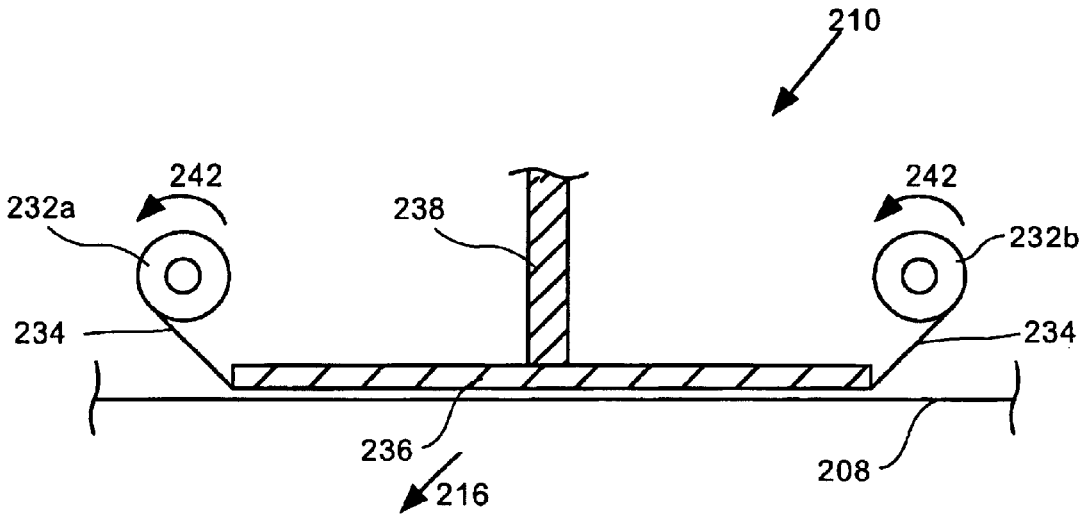
Figures 2, 2A, 3:
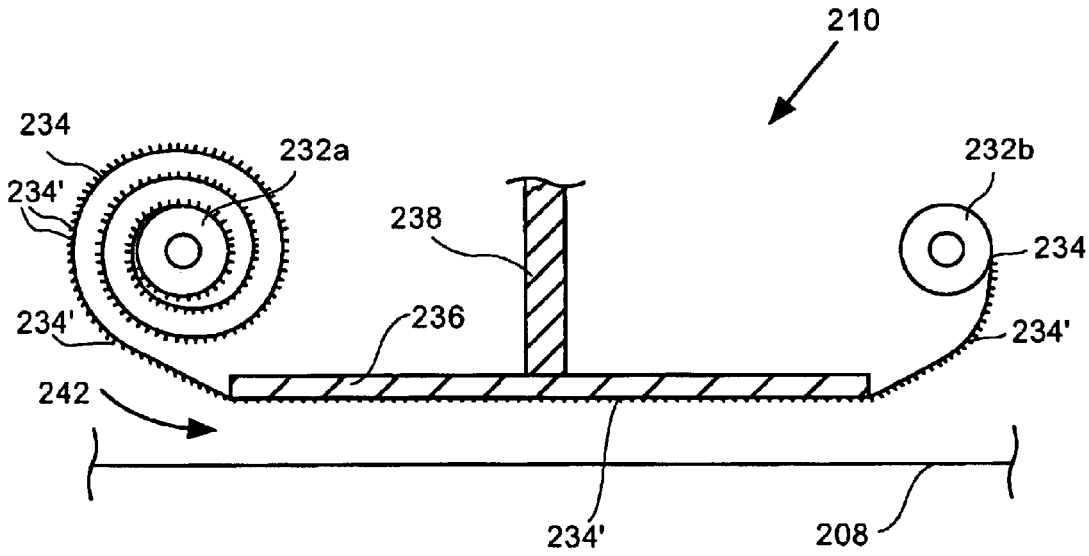

FIG. 2A-1 depicts a belt-type chemical mechanical polishing system (CMP) 200*a* utilizing a bar-type dressing assembly 210, in accordance with one embodiment of the present invention. In the CMP system 200*a*, an endless polishing pad 208 mounted on two drums 214 rotates in the polishing pad rotation direction 216. In a preferred embodiment, the polishing pad 208 is configured to be a fixed abrasive polishing pad. However, it must be understood by one skilled in the art that in a different embodiment, the polishing pad 208 may be any type of polishing pad (e.g., conventional CMP polishing pad irrespective of the fact that such polishing pad is a soft polishing pad or a hard polishing pad).

As shown, the drums 214 (herein also referred to as rollers) are aligned along a horizontal plane. Wrapped around the two drums 214, the polishing pad 208 defines a first horizontal plane and a second horizontal plane. The first horizontal plane defines the top of the polishing pad 208 while the second horizontal plane defines the bottom of the polishing pad 208. As can been seen, the first horizontal plane, the second horizontal plane, and the horizontal plane containing the drums 214 are parallel to each other.

Further depicted in FIG. 2A-1 is a platen 212 disposed below the fixed abrasive polishing pad 208 so as to provide a solid surface with air bearing or water bearing onto which a wafer can be applied. The platen 212 is further configured to stabilize the fixed abrasive polishing pad 208 as it rotates in the pad rotation direction 216. Also shown on the surface of the fixed abrasive polishing pad is a wafer application region 244 so as to identify the polishing interface of the wafer and the fixed abrasive polishing pad 208. In this embodiment, the dressing assembly 210 designed in a web-handling arrangement is positioned above the fixed abrasive polishing pad 208. As depicted, the contact interface between the dressing assembly 210 and the fixed abrasive polishing pad 208 precedes the wafer application region 244. As such, the dressing assembly 210 is configured to dress the surface of the fixed abrasive polishing pad 208 before the fixed abrasive polishing pad 208 polishes the surface layers of the wafer to be polished thus optimizing the polishing performance of the fixed abrasive polishing pad 208.

Also depicted in a bar-type dressing assembly 210 of CMP system 200*a* are a feed-roll 232*a* and a take-up roll 232*b* which, in this embodiment, are configured to be positioned above the fixed abrasive polishing pad 208. Additionally, in a preferred implementation, the feed-roll 232*a* and the take-up roll 232*b* are disposed symmetrically across one another such that a width of the feed-roll 232*a* and the take-up roll 232*b* are positioned substantially above and parallel to edges of the fixed abrasive polishing pad 208. The feed-roll 232*a* is configured to hold a roll of a dressing media 234 and to feed the dressing media 234 in the dressing media motion direction 242 to the take-up roll 232*b*, which in turn, is configured to receive the dressing media 234.

As such, preferably, the linear distance between the feed-roll 232*a* and the take-up roll 232*b* and thus the contact surface of the dressing media 234 and the fixed abrasive polishing pad 208 is configured to be substantially equivalent to the width of the fixed abrasive polishing pad 208. In this implementation, the feed-roll 232*a* and the take-up roll 232*b* are configured to have an approximate width $W_{233}$ of about 4 millimeters to about 100 millimeters. However, it is preferred that the width of the id feed-roll 232*a* and the take-up roll 232*b* range approximately from about 8 millimeters to about 25 millimeters, with a preferable approximate width of 15 millimeters.

Positioned above the dressing media 234 is a pressure application plate 236, which is configured to apply pressure to the dressing media 234 thereby causing the dressing media 234 to be applied to the fixed abrasive polishing pad 208. A stabilization member 240 having an application arm 238 is configured to apply the necessary pressure to the pressure application plate 236 so as to prevent the pressure application plate 236 from shifting on top of the dressing media 234. Preferably, in this embodiment, the size of the pressure application plate 236 is configured to be substantially equivalent to the contact surface of the dressing media 234 and the fixed abrasive polishing pad 208. Additionally, the pressure application plate 236 is configured to be pressed down on the fixed abrasive polishing pad 208 or to be raised above the fixed abrasive polishing pad 208 utilizing different mechanisms so long as the mechanisms are configured to be self aligning such that uniform distribution of pressure can be achieved (e.g., hydraulic mechanism, pneumatic mechanism, spring mechanism, etc.). Furthermore, the pressure application plate 236 can be constructed from any material (e.g., stainless steal, plastic, etc.) Although, in this embodiment, the pressure application plate 236 is in the shape of a rectangle, it must be understood by one skilled in the art, that the pressure application plate 236 may be in any shape so long as its function of pressing down on the dressing media 234 onto the fixed abrasive polishing pad 208 is achieved. Moreover, it must be understood by one skilled in the art, that the position of the feed-roll 232*a* and the take-up roll 232*b* can be interchanged with respect to one another so long as the function of the indexing of the dressing assembly 210 is achieved. Accordingly, in the embodiment of FIG. 2A-1, the dressing assembly 210 is configured to dress the fixed abrasive polishing pad 208 before the fixed abrasive polishing pad 208 reaches the wafer application region 244 thus removing the unwanted materials and exposing fresh abrasive particles preferably prior to the polishing operation. As such, the use of the web-style dressing assembly 210 optimizes the dressing operation of the fixed abrasive polishing pad 208 and provides a consistent fixed abrasive polishing pad conditioning over time.

Figures 1, 1A, 2:
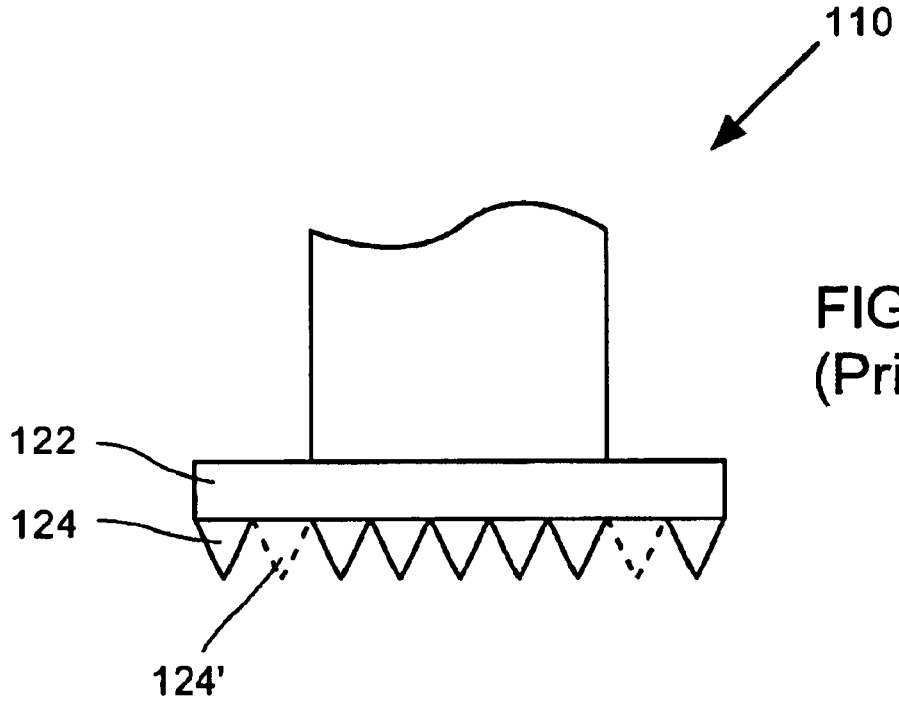
FIG. 1A-2 (Prior Art)
Figures 1, 1B:
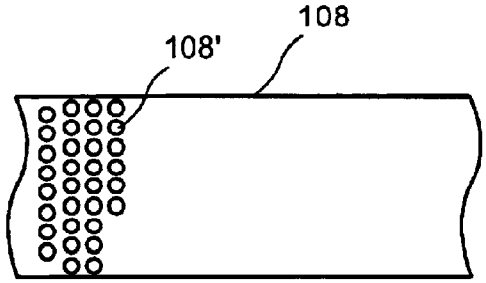
FIG. 1B-1 (Prior Art)
Figures 1, 1B, 2:
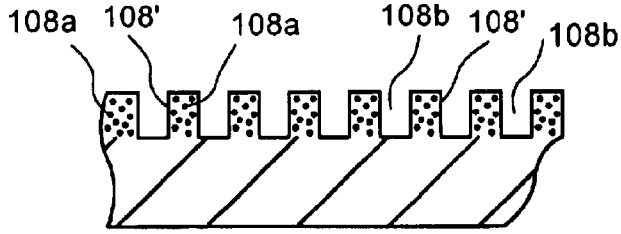
FIG. 1B-2 (Prior Art)

FIG. 2A-2 is a cross-sectional view of a dressing assembly 210, in accordance with one aspect of the present invention. Clearly illustrated are the relative positions of a feed-roll 232*a*, a take-up roll 232*b*, and a dressing media 234 with respect to a fixed abrasive polishing pad 208. As shown, initially, the feed-roll 232*a*, the take-up roll 232*b*, and the dressing media 234 are positioned above the fixed abrasive polishing pad 208. Also shown is a pressure application plate 236, which is defined on top of the dressing media 234. Once an application arm 238 presses down on the pressure application plate 236, the pressure application plate 236 and the dressing media 234 are pushed down thus applying the dressing media 234 to the fixed abrasive polishing pad 208 thereby dressing the fixed abrasive polishing pad 208 as it moves in a pad rotation direction 216.

Figures 1, 1B, 2, 3:
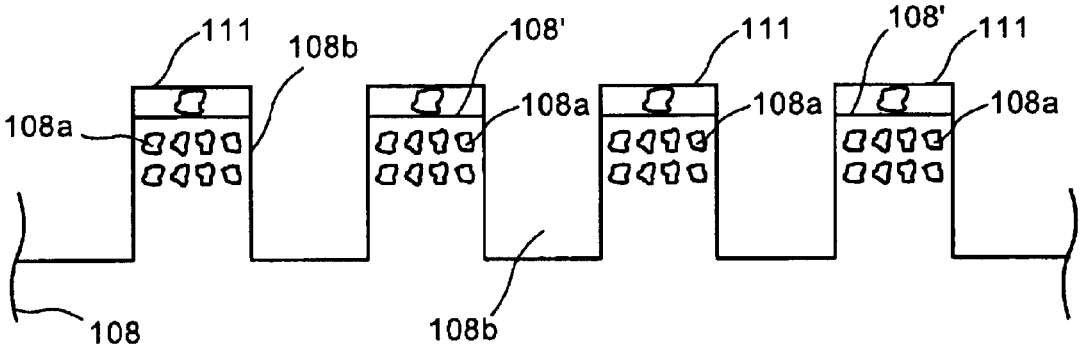
FIG. 1B-3 (Prior Art)
Figures 1, 1B, 2, 3, 4:
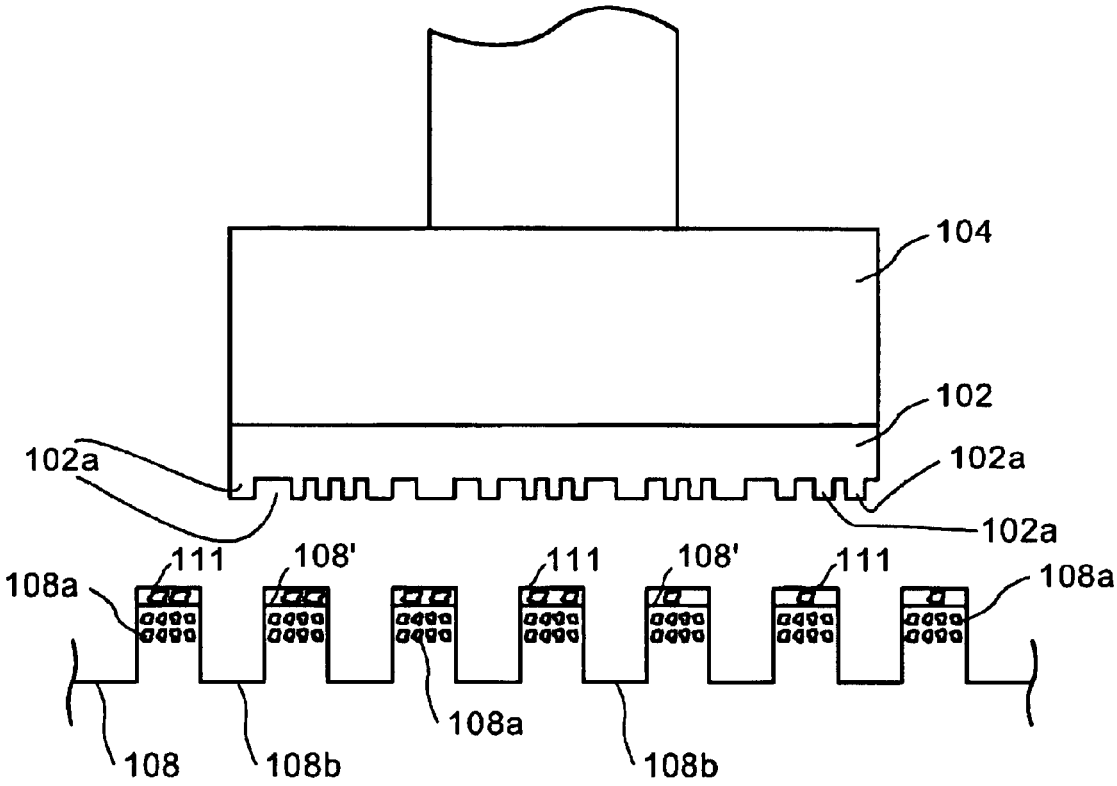
FIG. 1B-4 (Prior Art)

A simplified cross-sectional view of a dressing assembly 210, in accordance with one implementation of the invention, is depicted in FIG. 2A-3. As illustrated, a certain potion of a dressing media 234 is fed to a take-up roll 232*b*. After a fixed al abrasive polishing pad 208 has polished a given number of wafers, the portion of the dressing media 234 which came into contact with the fixed abrasive polishing pad 208, herein defined as a contact surface of the dressing media 234, loses its effectiveness to dress and must be replaced. Then, the used portion of the dressing media 234 is replaced by an unused portion of the dressing media 234 by way of the feed-roll 232*a* indexing the dressing media 234, utilizing a programmable rate. As such, for each CMP application, the indexing parameters can be optimized depending on the size of the abrasive particles as well as the fixed abrasive polishing pad area that needs to be polished. Furthermore, the indexing could be performed so as to place a fresh portion of the dressing media 234 over the entire width of the fixed abrasive polishing pad 208. Alternatively, in the situation wherein only a small portion of the dressing media 234 is needed to be replaced, the dressing assembly 210 can be programmed such that only a small portion of the dressing media 234 is indexed. As the dressing media 234 is indexed, the used portions of the dressing media 234 are collected by the take-up roll 232*b*. Once the supply of the dressing media 234 of the feed-roll 232*a* is completely consumed, it can easily be replaced with a new roll of dressing media 234. The process of re-supplying the feed-roll 232*a* with the dressing pad media 234 is neither time consuming nor labor intensive. More importantly, the CMP machine will be off-line, if necessary, less frequently and for a significantly less amount of time thereby causing minimal effect on the throughput of the machine.

Simply illustrated in FIG. 2A-3 is an abrasive layer 234' of the dressing media 234. The dressing media 234 is loaded on the feed-roll 232*a* and a take-up roll 232*b* such that the abrasive layer 234' of the dressing media 234 is exposed. Thus, once the application arm 238 applies the pressure application plate 236 onto the dressing media 234, it is configured that the abrasive layer 234' of the dressing media 234 comes into contact with the fixed abrasive polishing pad 208. As such, the abrasive layer 234' is configured to have a plurality of abrasive particles defined as units such that the abrasive units contact the fixed abrasive polishing pad 208 thereby removing the polymer material from the pillars of the fixed abrasive polishing pad 208 so as to expose fresh abrasive particles on the pillars. In a preferred embodiment, the average size of the abrasive units, of the abrasive layer 234' is configured to be approximately on the order of few micrometers. The abrasive units, may be defined as diamonds or any other abrasive material so long as their function of removing polymers or unwanted particulates is achieved.

Figures 1, 2B:
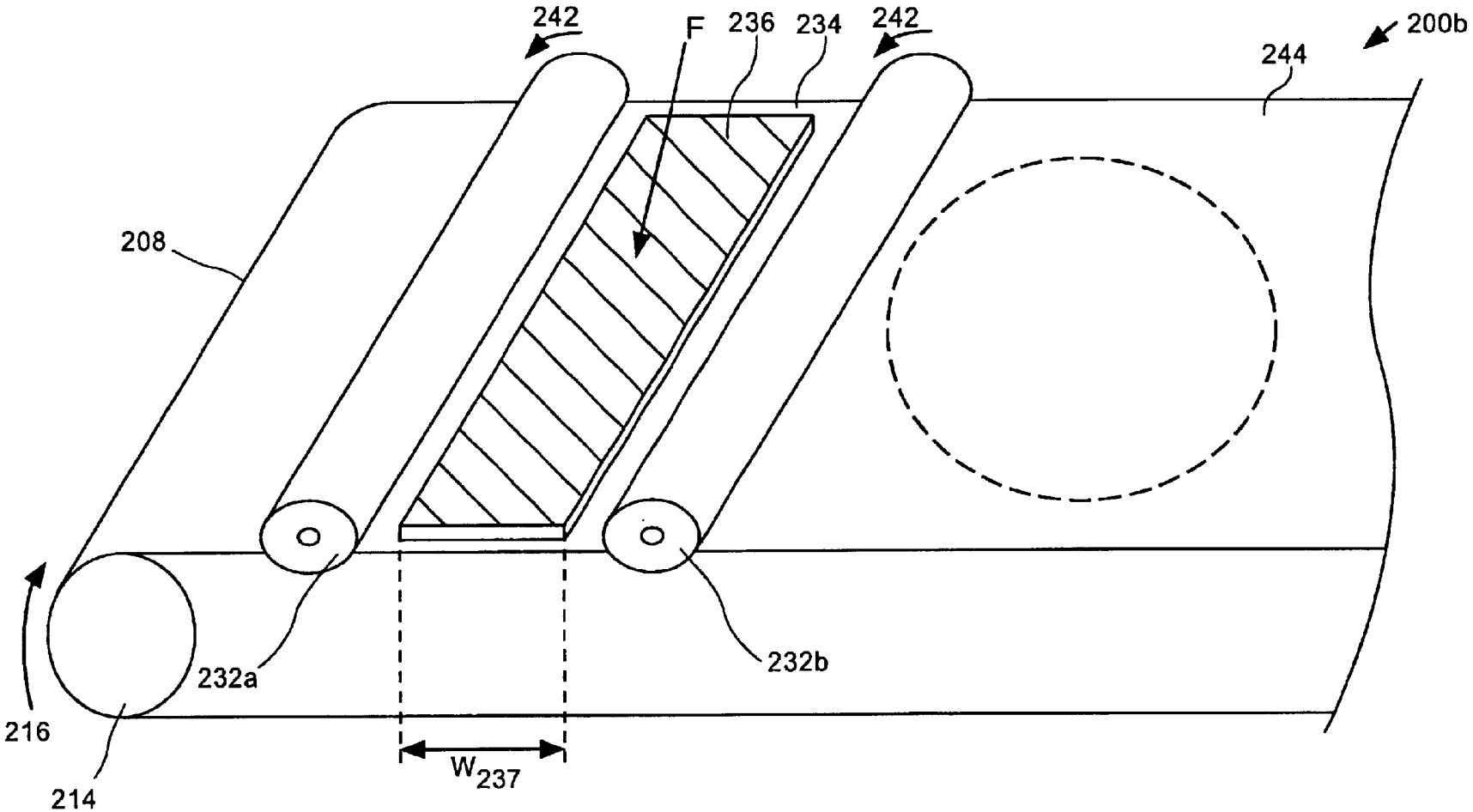
Figures 2, 2B:
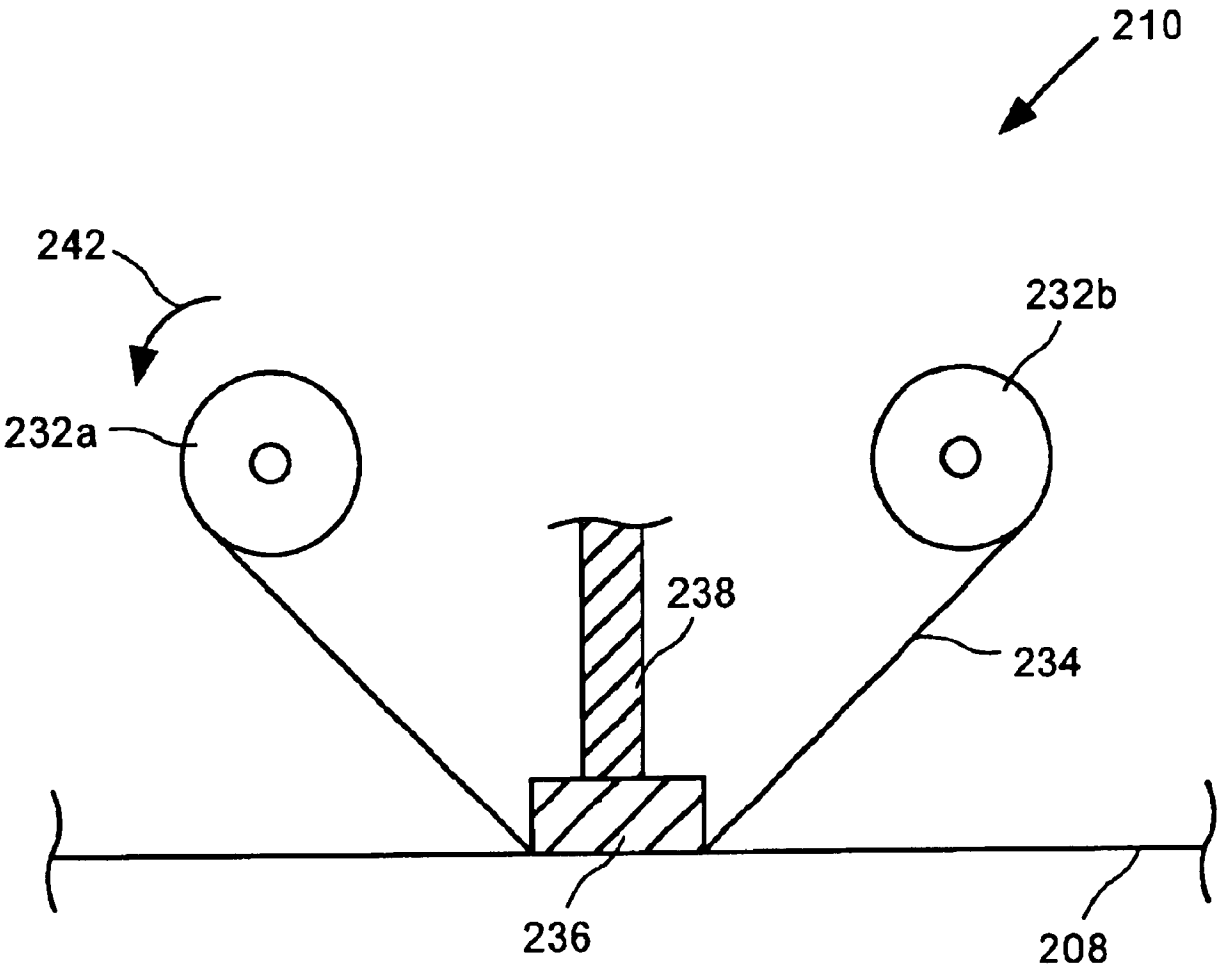

The embodiment of FIG. 2B-1 depicts a dressing assembly 210 of a belt-type CMP system 200*b*, in accordance with another embodiment of the present invention. A polishing pad 208 mounted on two drums 214 rotates in the pad rotation direction 216. Preferably, in this implementation, the polishing pad 208 is a fixed abrasive polishing pad. A circular wafer application region 244 is defined on top of the fixed abrasive polishing pad 208 and represents the polishing interface between the fixed abrasive polishing pad 208 and the wafer to be polished. In this embodiment, a feed-roll 232*a* and a take-up roll 232*b* are positioned above the fixed abrasive polishing pad 208 and are configured to rotate in the dressing media motion direction 242. Preferably, in this implementation, a width of the feed-roll 232*a* and the take-up roll 232*b* are configured to be substantially equivalent to a width of the fixed abrasive polishing pad 208. As such, the feed-roll 232*a* and the take-up roll 232*b* are configured to be defined substantially parallel to the drums 214.

Further depicted is a pressure application plate 236 having been disposed on top of the dressing media 234 so as to stabilize the dressing media 234 while the dressing media 234 is being pressed down onto the fixed abrasive polishing pad 208. As illustrated, in this embodiment, the contact surface of the dressing media 234 precedes the polishing interface of the fixed abrasive polishing pad 208 and the wafer to be polished. Accordingly, the fixed abrasive polishing pad 208 is dressed before it reaches the wafer application region 244 thus ensuring the presence of adequate amount of abrasive units at the polishing interface. As clearly illustrated, the dressing assembly 210 of this embodiment can be implemented such that the contact surface of the dressing media 234 may vary depending on the extent of dressing required by the fixed abrasive polishing pad 208. However, preferably, a width $W_{237}$ of the pressure application plate 236 and thus the contact surface of the dressing media 234 with the fixed abrasive polishing pad 208 is configured to have an approximate range of about 4 millimeters to about 100 millimeters, and preferably the width $W_{237}$ of the pressure application plate 236 is approximately about 12 millimeters. FIG. 2B-2 is a simplified cross-sectional illustration of a dressing assembly 210 depicting the flexibility of implementing a dressing assembly wherein the contact surface of the dressing media 234 is substantially smaller. As such, this implementation limits the length of time any given portion of the fixed abrasive polishing pad 208 is dressed thus substantially reducing the possibility of an undesired over dressing or under dressing of the fixed abrasive polishing pad 208.

Figure 3A:
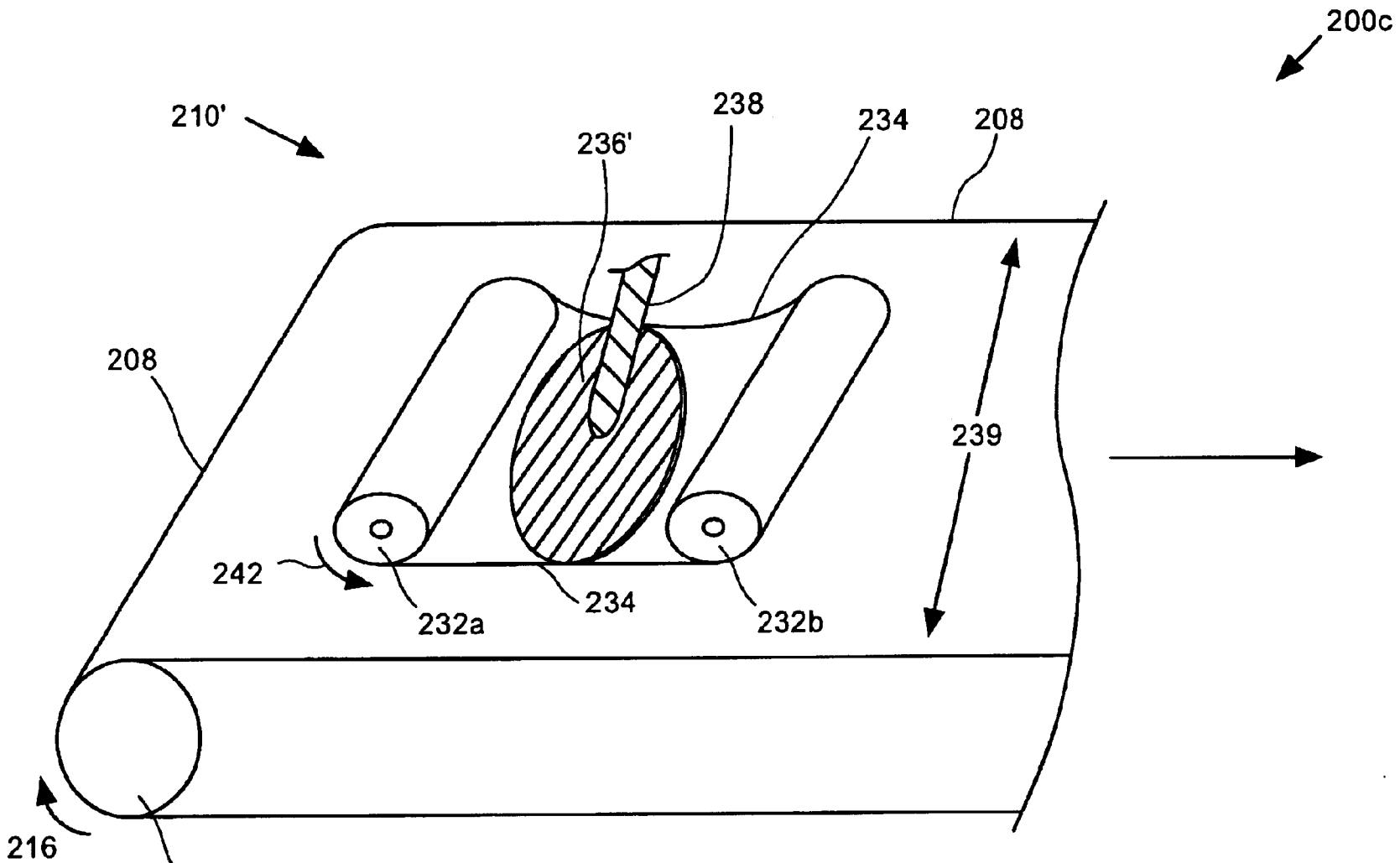
FIG. 3A is an illustration of a belt-type CMP system wherein a dressing assembly moves across a polishing pad, in accordance with another implementation of the present invention.

The embodiment of FIG. 3A depicts a belt-type CUP system 200*c* wherein a dressing assembly 210' is configured to move across a polishing pad 208, in accordance with another implementation of the present invention. The polishing pad 208 of the CMP system 200*c* is mounted on drums 214 and is preferably a fixed abrasive polishing pad. As shown, a feed-roll 232*a*, a take-up roll 232*b*, and a dressing media 234 are configured to be disposed above the fixed abrasive polishing pad 208. Preferably, in this embodiment, lengths of the feed-roll 232*a*, the take-up roll 232*b*, and a pressure application disk 236' of the dressing assembly 210' are configured to be smaller than the width of the polishing pad 208. In the preferred implementation, the length of the feed-roll 232*a* and the take-up roll 232*b* range approximately from about 12 millimeters to about 75 millimeters. Furthermore, as the dressing assembly 210' moves across the fixed abrasive polishing pad 208 in the movement direction 239, it is preferred that the pressure application plate 236' be in a shape of a disk. As such, it is preferable that a diameter of the pressure application disk 236' be equivalent to the length of the feed-roll 232*a* and the take-up roll 232*b*. Accordingly, in the preferred implementation, the diameter of the pressure application disk 236' approximately ranges from about 12 millimeters to about 75 millimeters, preferably having a diameter of approximately about 25 millimeters. Furthermore, the thickness of the pressure application disks 236' ranges from approximately about 2 millimeters to about 30 millimeters. Of course, other disk-like shapes, rectangular shapes, square shapes, and the like may also work so long as the desired conditioning operation is achieved.

Figure 3B:
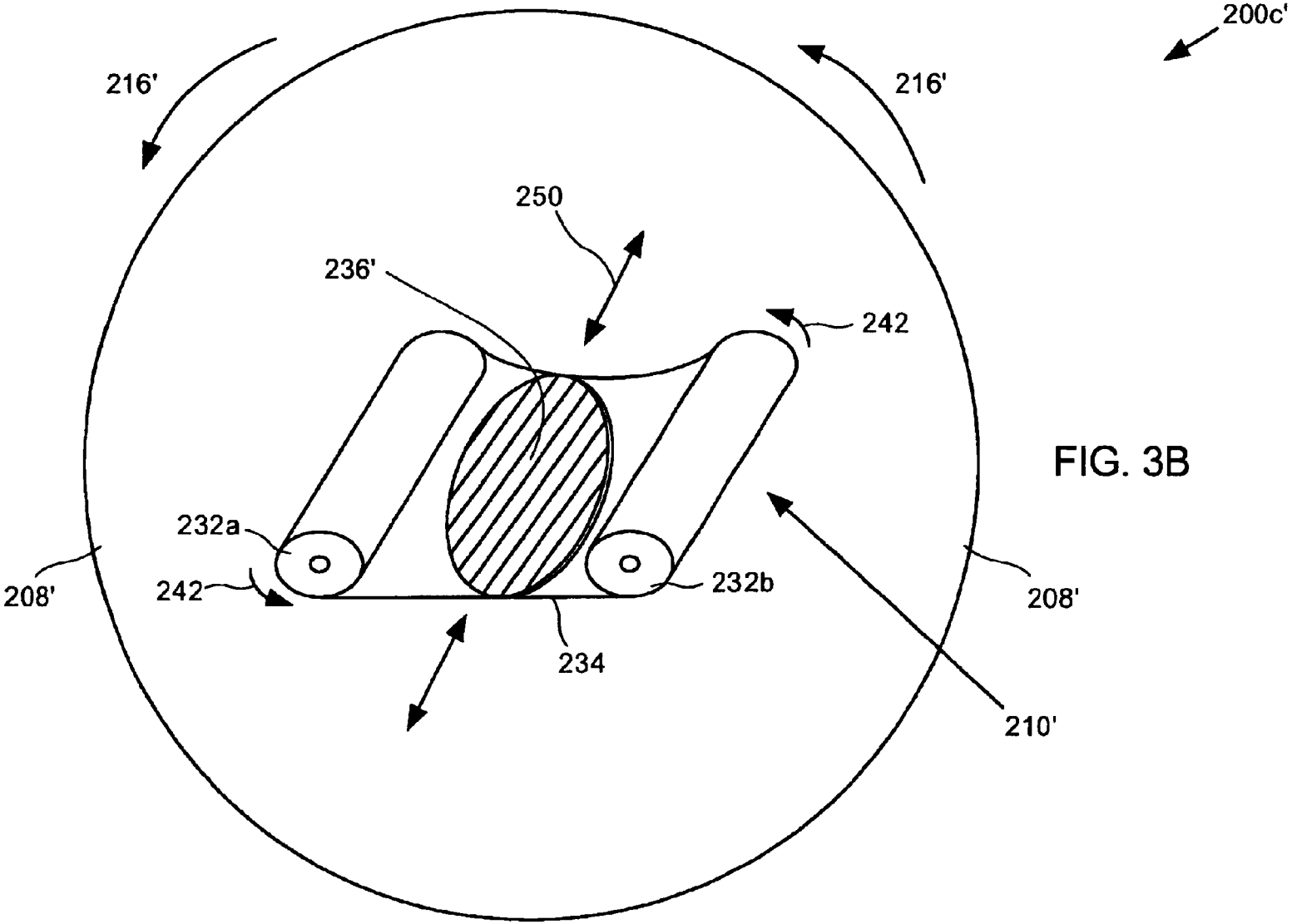
FIG. 3B is an illustration of a rotary-type CMP system wherein a dressing assembly dresses a polishing disk as it moves from a center of the disk to an edge of the disk and from the edge of the disk to the center of the disk, in accordance with yet another embodiment of the present invention.

In a like manner, the embodiment of FIG. 3B depicts a rotary-type CMP system 200*c'* wherein a dressing assembly 210' is configured to dress a polishing disk 208'. In this implementation, the dressing assembly 210' is configured to move in the movement direction 250, from a center of the polishing disk 208' to an edge of the polishing disk 208' and from the edge of the polishing disk 208' to the center of the polishing disk 208'. Preferably, the polishing disk 208' of the CMP system 200*c'* is configured to be a fixed abrasive polishing pad.

Figure 4A:
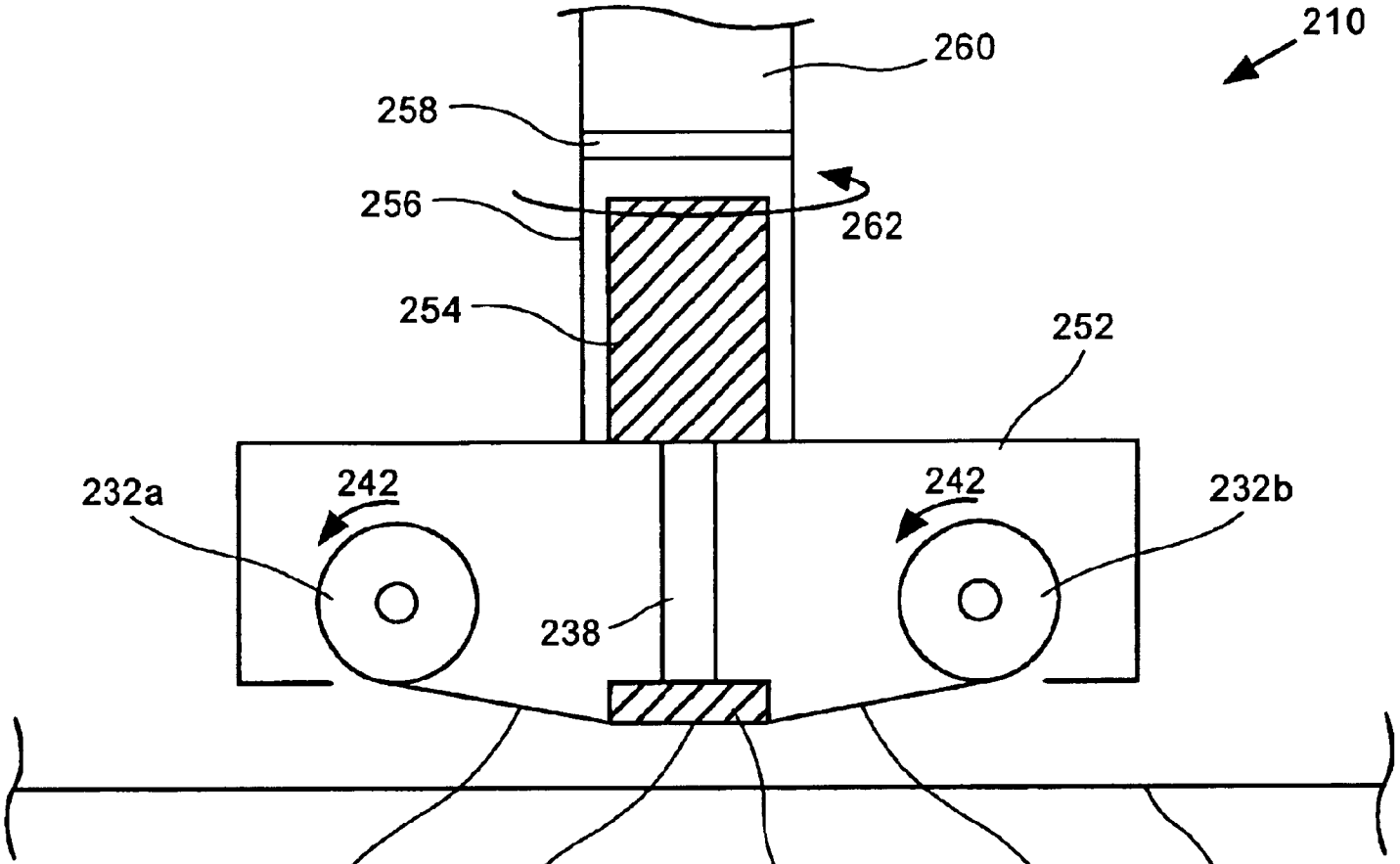
FIG. 4A depicts a dressing assembly housed in a container, wherein a pressure application plate is in the shape of a rectangle, in accordance with yet another embodiment of the present invention.

A dressing assembly 210 of the embodiment of the FIG. 4A is configured to include a feed-roll 232*a* and a take-up roll 232*b* wherein a dressing media 234 is fed from the feed-roll 232*a* to the take-up roll 232*b* in a dressing media motion direction 242. The feed-roll, the take-up roll, and the dressing media 234 are configured to be located above the polishing pad 208. In this embodiment, the polishing pad 208 is configured to be a fixed abrasive polishing pad. As depicted, an application arm 238 is configured to apply pressure to a pressure application plate 236 thus pressing down on the dressing media 234 thereby causing the dressing media 234 to be applied to the fixed abrasive polishing pad 208. Preferably, in this implementation, the feed-roll 232*a*, the take-up roll 232*b*, the dressing media 234, the application arm, and the pressure application plate 236 of the dressing assembly 210 are configured to be sheltered by a housing 252 thus preventing the dressing assembly 210 from being contaminated by drips, water, splashes and etc. Furthermore, the dressing assembly 210 is mounted on a container 256 containing a pressure controller 254. As such, the container 256 and thus the dressing assembly 210 are configured to rotate in the rotation direction 262. Accordingly, the dressing assembly 210 dresses the fixed abrasive polishing pad 208 while it rotates and moves over the fixed abrasive polishing pad 208 thereby exposing fresh abrasive particles.

Figure 4B:
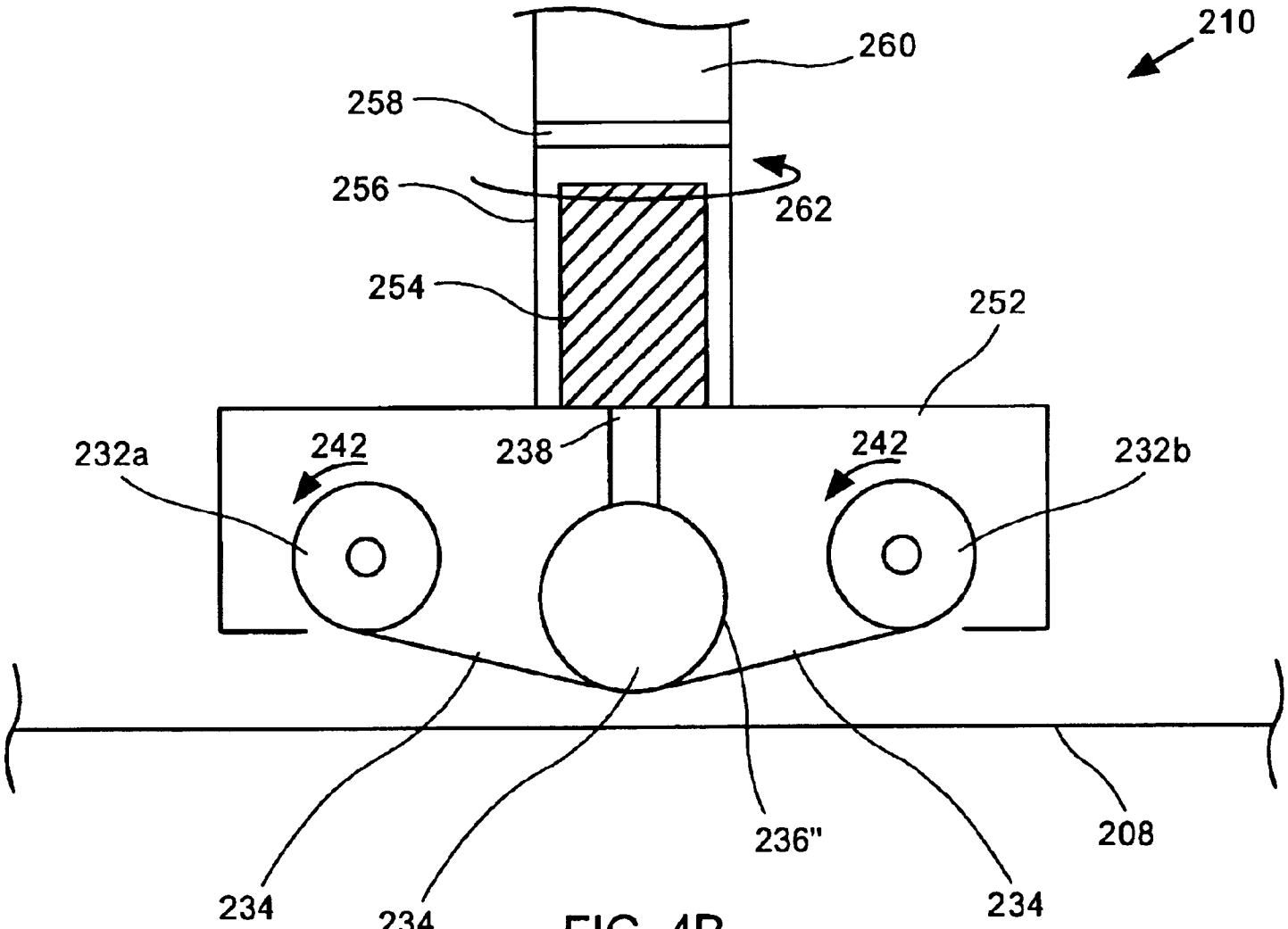
FIG. 4B depicts a dressing assembly housed in a container, wherein a pressure application member is in the shape of a roller, in accordance with another aspect of the invention.

In a different embodiment, as illustrated in FIG. 4B, a pressure application member 236" is configured to be in a shape of a roller. Thus, as illustrated, the pressure application member 236" may be in any shape so long as its function of pressing down on the dressing media 234 and onto the fixed abrasive polishing pad 208 is achieved.

Although the foregoing invention has been described in some detail for purposes of clarity of understanding, it will be apparent that certain changes and modifications may be practiced within the scope of the appended claims. For example, embodiments described herein have been primarily directed toward wafer conditioning; however, it should be understood that the conditioning operations are well suited for conditioning of any type of substrate. Furthermore, implementations described herein have been particularly directed toward dressing of fixed abrasive polishing pads; however, it should be understood that the conditioning operations are well suited for conditioning of any type of polishing pad. Accordingly, the present embodiments are to be considered as illustrative and not restrictive, and the invention is not to be limited to the details given herein, but may be modified within the scope and equivalents of the appended claims.

What is claimed is:

1. A polishing pad conditioner for use in a chemical mechanical polishing (CMP) apparatus, comprising:

a fixed abrasive polishing pad having an abrasive polishing surface;

a web dressing media having a contact surface defined between a first point and a second point, the first point being separate from the second point, wherein the web dressing media is configured to be positioned over the fixed abrasive polishing pad such that the contact surface of the web dressing media is configured to be applied to the abrasive polishing surface of the fixed abrasive polishing pad;

a pressure application plate configured to be applied against an application surface of the web dressing media that is an opposite surface to the contact surface and is defined between a first position and a second position of the application surface of the web dressing media;

a feed-roll positioned above the fixed abrasive polishing pad, the feed-roll being configured to have a supply of the web dressing media, the feed-roll is positioned at about the first point; and a take-up roll positioned above the fixed abrasive polishing pad, the take-up roll being configured to collect at least a linear portion of the web dressing media, the take-up roll is positioned at about the second point, wherein the dressing media, the feed-roll, and the take-up roll define a web handling system, the web handling system being enclosed in a housing configured to rotate.

2. A polishing pad conditioner as recited in claim 1, further comprising:

a stabilization member for controllably applying the pressure application plate to the web dressing media so as to apply the web dressing media to the surface of the polishing pad.

3. A polishing pad conditioner for use in a chemical mechanical polishing (CMP) apparatus, comprising:

a fixed abrasive polishing pad having an abrasive polishing surface;

a web dressing media having a contact surface defined between a first point and a second point, the first point being separate from the second point, wherein the web dressing media is configured to be positioned over the fixed abrasive polishing pad such that the contact surface of the web dressing media is configured to be applied to the abrasive polishing surface of the fixed abrasive polishing pad; and a pressure application plate configured to be applied against an application surface of the web dressing media that is an opposite surface to the contact surface and is defined between a first position and a second position, wherein the web dressing media and the pressure application plate are enclosed in a housing configured to rotate.

4. A polishing pad conditioner as recited in claim 3, further comprising:

a feed-roll positioned above the fixed abrasive polishing pad, the feed-roll being configured to have a supply of the web dressing media, the feed-roll being positioned at about the first point; and a take-up roll positioned above the fixed abrasive polishing pad, the take-up roll being configured to collect at least a linear portion of the web dressing media, the take-up roll being positioned at about the second point.

5. A polishing pad conditioner for use in a chemical mechanical polishing (CMP) apparatus, comprising:

a web dressing media defined between a first point and a second point, the first point being separate from the second point, the web dressing media having an application surface and a contact surface, the application surface being an opposite surface to the contact surface;

a pressure application member configured to be applied against the application surface of the web dressing media causing the contact surface of the web dressing media defined opposite to the portion of the application surface to be applied onto a pad surface;

a feed-roll configured to have a supply of the web dressing media, the feed-roll being positioned at about the first point; and a take-up roll configured to collect at least a linear portion of the web dressing media, the take-up roll being positioned at about the second point, wherein the web dressing media, the feed-roll, and the take-up roll define a web handling system, the web handling system configured to rotate.

6. A polishing pad conditioner as recited in claim 5, wherein the pressure application member can be one of a plate, a disk, and a roller.

* * * * *